US005258898A

United States Patent [19]

Thornton

[11] Patent Number: 5,258,898

[45] Date of Patent: Nov. 2, 1993

[54] ELECTRIC LIGHTING SUPPORT ASSEMBLY

[75] Inventor: Gerry F. Thornton, Christiansburg, Va.

[73] Assignee: Hubbell Incorporated, Orange, Conn.

[21] Appl. No.: 810,109

[22] Filed: Dec. 19, 1991

[51] Int. Cl.[5] ..... F21V 23/04

[52] U.S. Cl. ..... 362/394; 362/432; 362/147

[58] Field of Search ..... 362/393, 432, 427, 147, 362/269

[56] References Cited

U.S. PATENT DOCUMENTS

| | | | |
|---|---|---|---|
| 1,549,291 | 8/1925 | Broman | 362/427 X |
| 1,826,105 | 10/1931 | Veale | 362/394 X |
| 4,319,314 | 3/1982 | Morton | 362/432 |
| 4,880,193 | 11/1989 | Warshawsky | 362/427 X |

*Primary Examiner*—Larry Jones

*Attorney, Agent, or Firm*—Jerry M. Presson; Michael R. Swartz

[57] ABSTRACT

An electric lighting support assembly includes an elongated hollow tubular arm having a plurality of circumferentially and axially spaced wall portions, an electric light supported on the arm, wiring connected to the electric light and running through the arm, an entry aperture for receiving an electric power supply line into the arm at a first of the wall portions, an access opening for gaining access to an electrical connection between the electric power supply line and the wiring in the tubular arm at a second of the wall portions spaced from the first wall portion, and a cover removably attached to the arm at the second wall portion thereof so as to overlie and close the access opening in the arm such that the cover can be removed and reattached without affecting the electrical connection between the electric power supply line and the wiring. The tubular arm has opposing top and bottom sides and opposing lateral sides. The first wall portion which contains the entry aperture is preferably located on the top side of the arm, whereas the second arm portion which contains the access opening is located on one of the lateral sides or bottom side of the arm.

12 Claims, 2 Drawing Sheets

ELECTRIC LIGHTING SUPPORT ASSEMBLY

BACKGROUND OF THE INVENTION

1. Field of the Invention

The present invention generally relates to an industrial lighting support assembly and, more particularly, is concerned with an improved electric lighting support assembly which permits inspection of electric connections without physically disturbing them.

2. Description of the Prior Art

A wide variety of lighting support assemblies are used in industrial applications for illuminating railroad and truck loading docks. One typical prior art lighting support assembly employs a hollow tubular arm with one end of the arm attached on a suitable mounting bracket, an electrical lamp mounted at an opposite end of the arm, and wiring for the lamp enclosed within the tubular arm. One typical way to connect a power supply line to the wiring of the assembly has been to attach a junction box to an external surface of the tubular arm and make the connection between the power supply line and the wiring within the junction box.

U. S. Pat. No. 4,319,314 to Morton discloses a lighting support assembly which corresponds in the basic components of its construction to that described above. However, the lighting support assembly of the Morton patent seeks to improve this typical prior art construction by eliminating the need to use an external junction box on the top of the tubular arm. In its place, the Morton patent provides an opening in a selected top portion of the tubular arm and a removable cover plate applied over the opening. The cover plate has an entry hole with a strain connector mounted through it. The power supply line passes through the entry hole via the strain connector mounted in the cover plate. The required electric connection between the electric power supply line and the wiring of the lighting support assembly is found within the tubular arm proximate the opening closed by the removable cover plate.

A major drawback of the lighting support assembly of the Morton patent is that whenever the cover plate is removed from and then reattached to the tubular arm the power supply line is physically disturbed since it extends through the cover plate. This physical disturbance of the power supply line results in physical disturbance of the electrical connection that exist between it and the wiring of the assembly. Then, after the cover plate has been reattached, a person inspecting the electrical connection cannot have a sufficient degree of confidence that the electrical connection is still secure and adequate.

Consequently, a need exists to provide an improved lighting support assembly which eliminates the above-described drawback of the lighting support assembly of the Morton patent without introducing a new one in its place.

SUMMARY OF THE INVENTION

The present invention provides an improved electric lighting support assembly designed to satisfy the aforementioned needs. The improvement provided by the lighting support assembly of the present invention separates the location of entry of the power supply line into the tubular arm from the location where access can be gained to the interior of the tubular arm to inspect the electrical connection between the power supply line and the wiring of the lighting support assembly without physically disturbing the electrical connection.

Accordingly, the present invention is directed to an electric lighting support assembly which comprises: (a) an elongated hollow tubular arm having a plurality of spaced wall portions; (b) an electric light supported on the arm; (c) wiring connected to the electric light and running through the tubular arm; (d) means defining an aperture for entry of an electric power supply line into the tubular arm at a first of the wall portions; (e) means defining an opening for access to an electrical connection between the wiring and electric power supply line in the tubular arm at a second of the wall portions being spaced from the first wall portion; and (f) a cover removably attached to the tubular arm and closing the access opening at the second wall portion. The entry aperture is adapted to receive the electric power supply line through it and into the tubular arm for making an electrical connection with the wiring. The access opening is located adjacent to the location of the electrical connection between the electric power supply line and the wiring for permitting making of, and providing access to, the electrical connection between the electric power supply line and the wiring. The removable cover can be removed and reattached without affecting the electrical connection between the electric power supply line and the wiring.

More particularly, the first and second wall portions of the tubular arm are axially and circumferentially spaced from one another. The tubular arm has opposing top and bottom sides and opposing lateral sides. The first wall portion containing the entry aperture is preferably located on the top side of the tubular arm. The second arm portion containing the access opening is preferably located on one of the lateral and bottom sides of the tubular arm.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, wherein like reference characters designate like or corresponding parts throughout the several views, reference will be made to the attached drawings in which.

DETAILED DESCRIPTION OF THE INVENTION

Figure 1:
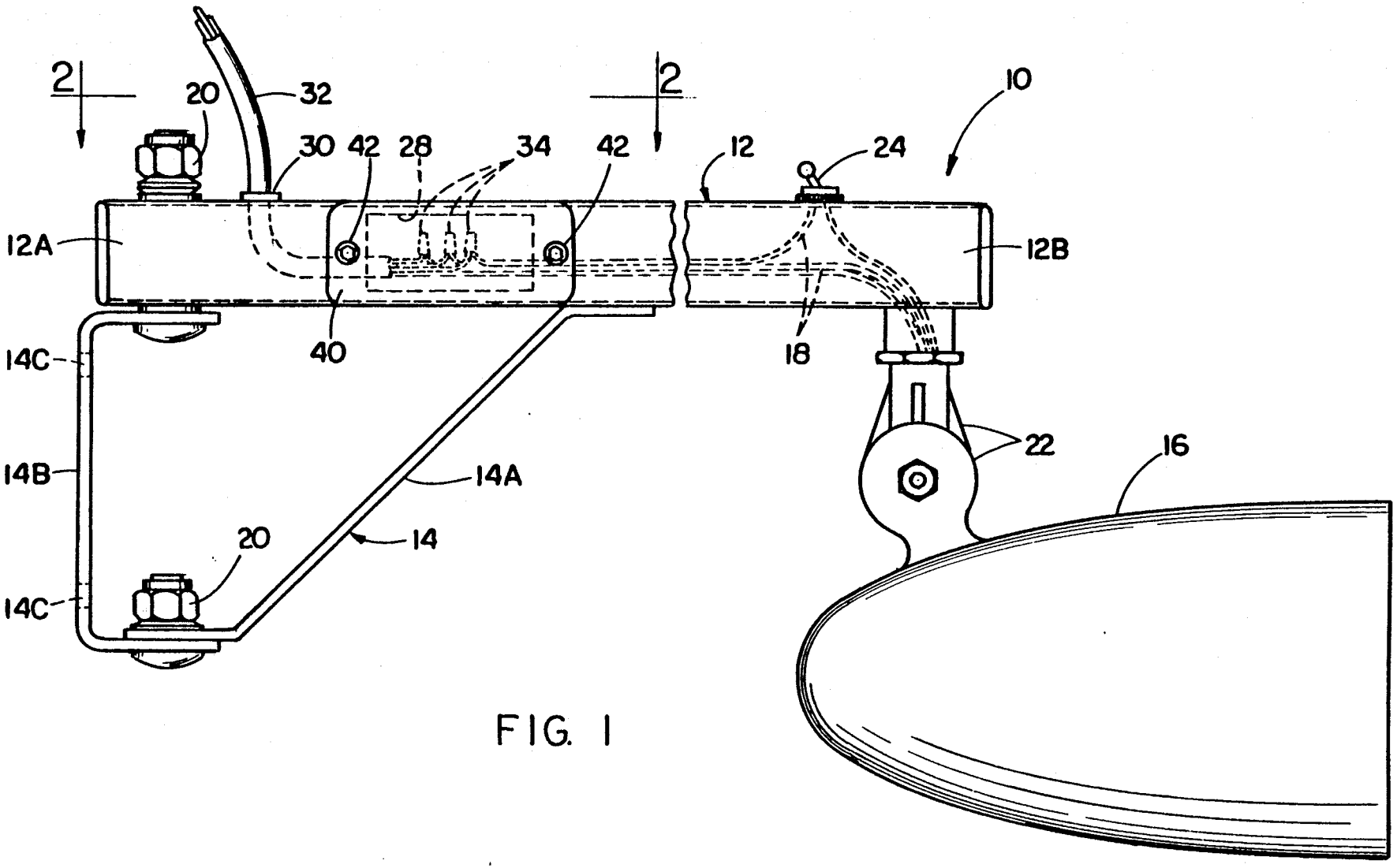
FIG. 1 is a side elevational view of an electric lighting support assembly of the present invention.
Figure 3:
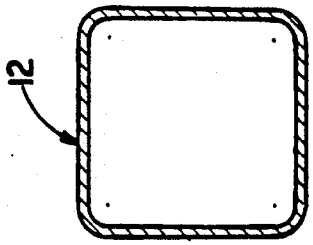
FIG. 3 is a cross-sectional view of the lighting support assembly taken along line 3—3 of FIG. 2.
Figure 2:
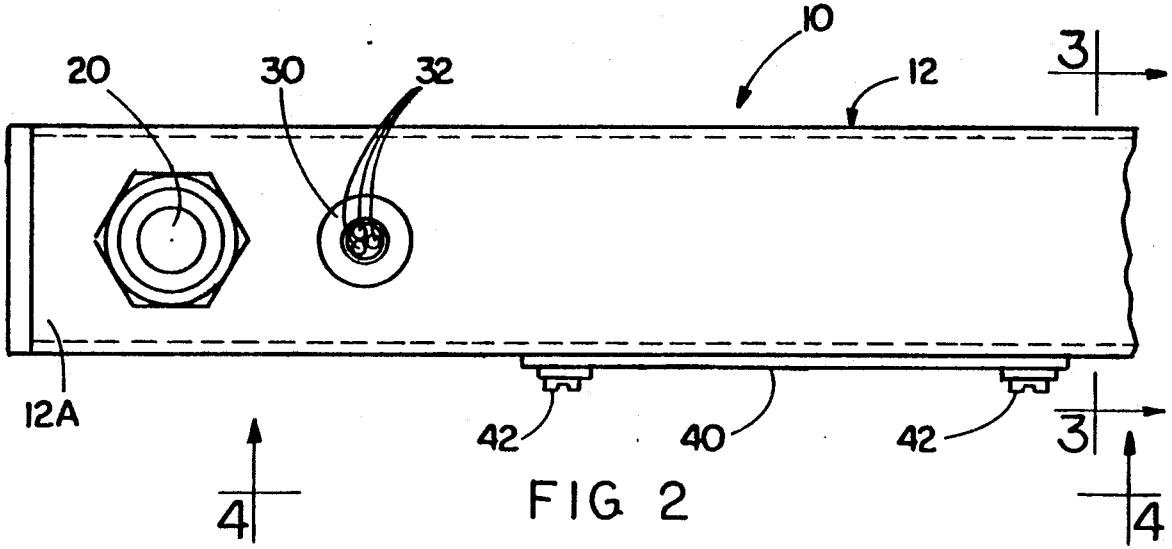
FIG. 2 is a fragmentary top plan view of the lighting support assembly as seen along line 2—2 of FIG. 1.

Referring now to the drawings, and particularly to FIGS. 1-3, there is schematically illustrated an electric lighting support assembly, generally designated 10, in accordance with the present invention. Basically, the lighting support assembly 10 includes an elongated hollow tubular arm 12, a support bracket 14, an electric light 16, and wiring 18 connected to the electric light 16. In the illustrated embodiment, the hollow tubular arm 12 is rectangular in cross-sectional, although it can equally have a circular cross-sectional shape.

The support bracket 14 includes an inclined portion 14A which is rigidly attached, such as by welding or brazing, to the tubular arm 12 and a U-shaped portion 14B which is pivotally attached at its opposite ends by fasteners 20 to one end of the inclined bracket portion 14A and one end 12A of the tubular arm 12. The U-shaped bracket portion 14B has holes 14C by which the bracket 14 can be attached to an external structure, such as a building wall, for supporting the tubular arm 12 in cantilevered fashion from the external structure.

The electric light 16, being conventional per se, is supported at an opposite end 12B of the tubular arm 12 by an adjustable pivotal joint 22 attached between the light 16 and the opposite end 12B of the arm. The wiring 18 is connected at one end to the electric light 16 and runs through the tubular arm 12. The wiring 18 can be the typical three-conductor electric wiring to provide a grounded cord. An on-off switch 24 is mounted near the opposite outer end 12B of the arm 12 and is electrically connected to one of the conductors of the wiring 18.

Referring to FIGS. 1 and 2, in accordance with the improvement provided by the present invention, the lighting support assembly 10 includes an entry aperture 26 defined in the tubular arm 12 near its one end 12A and an access opening 28 defined in the tubular arm 12 in spaced relation to the aperture 26. A grommet 30 may be mounted in the entry aperture 26. An electric power supply line 32 is received through the aperture 26, via the grommet 30, and runs within the hollow tubular arm 12 to the region of the arm 12 where the end of the wiring 18 is located therein. An electrical connection 34 is made between the ends of the wiring 18 and the electric power supply line 30 at such region of the arm 12.

Referring to FIGS. 1–4, the tubular arm 12 has opposing top and bottom sides and opposing lateral sides. The entry aperture 26, which provides for entry of the electric power supply line 32 into the arm 12, is contained in a first wall portion 36, being preferably located on the top side of the arm. The access opening 28, which is located adjacent to the location of the electrical connection 34 between the end of the electric power supply line 32 and the end of the wiring 18 for permitting the making of and providing access to the electrical connection 34, is contained in a second wall portion 38, being preferably located on one of the lateral sides of the arm 12 although it could as readily be located on the bottom side of the arm. Thus, the first and second wall portions 36, 38 of the tubular arm 12 are spaced axially and circumferentially from one another respectively along and about the tubular arm 12.

Figure 4:
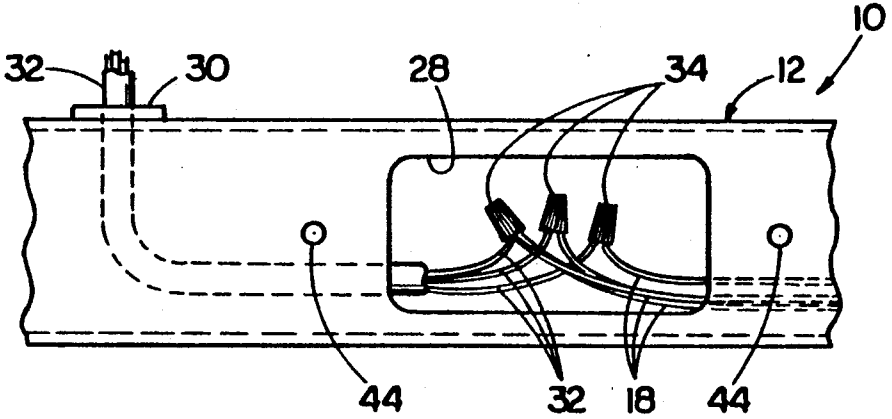
FIG. 4 is an enlarged fragmentary side elevational view of the lighting support assembly as seen along line 4—4 of FIG. 2, but with the cover plate of the assembly removed.

Referring to FIGS. 1, 2 and 4, also in accordance with the improvement provided by the present invention, the lighting support assembly 10 includes a cover 40, such as in the form of a flat plate, being removably attached to the tubular arm 12 at the second wall portion 38 thereof so as to overlie and close the access opening 28 in the tubular arm. The access opening 28 and cover 40 can both have generally rectangular shapes with the cover being larger than the access opening. Of course, they can have other shapes as well.

The cover 40 is attached to the arm 12 by screws 42 inserted and tightened through aligned holes 44 in the cover 40 and arm 12 such that the cover 40 can readily removed and reattached. As can be observed in FIG. 1, the cover 40 is absent any aperture which would align with the access opening 28 in the tubular arm 12 when the cover 40 is attached to the arm 12 and permit entry of either the electric power supply line 32 or the wiring 18 through the cover 40 and through the access opening 28 in the arm 12. Since the electric power supply line 32 does not enter the tube 12 through the cover 40, the cover 40 can be removed and reattached without disturbing and affecting the electrical connection 34 between the electric power supply line 32 and the wiring 18.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

I claim:

1. An electric lighting support assembly, comprising:

(a) an elongated hollow tubular arm having a pair of opposite ends and a plurality of sides extending between said opposite ends, said sides having a plurality of spaced wall portions;

(b) an electric light supported on said arm;

(c) wiring connected to said electric light and running through said arm;

(d) means defining an aperture for entry of an electric power supply line into said arm at a first of said wall portions of said sides of said arm;

(e) means defining an opening in said arm for access to an electrical connection between said wiring and the electric power supply line, said access opening being defined in said arm at a second of said wall portions of said sides of said arm being spaced from said first wall portion thereof; and (f) a cover removably attached to said arm at said second wall portion thereof so as to overlie and close said access opening in said arm, said cover being absent any aperture which would align with said access opening in said second wall portion of said arm when said cover is attached to said arm and permit entry of either of said electric power supply line or said wiring through said cover and through said access opening in said second wall portion of said arm.

2. The assembly as recited in claim 1, wherein said first and second wall portions of said arm are axially spaced from one another along said arm.

3. The assembly as recited in claim 1, wherein said first and second wall portions of said arm are circumferentially spaced from one another about said 4. The assembly as recited in claim 1, wherein said first and second wall portions of said arm are circumferentially and axially spaced from one another respectively along and about said arm.

5. The assembly as recited in claim 1, wherein said plurality of sides of said arm includes opposing top and bottom sides and opposing lateral sides, said first wall portion containing said entry aperture being located on said top side of said arm, said second arm portion containing said access opening being located on one of said lateral and bottom sides of said arm.

6. The assembly as recited in claim 1, further comprising:

a bracket spaced from said electric light and attached to said tubular arm for supporting said arm from an external structure, said bracket being attached to one of said opposite ends of said arm and said electric light being attached to the other of said opposite ends of said arm.

7. An electric lighting support assembly, comprising:

(a) an elongated hollow tubular arm having a pair of opposite ends and a plurality of sides extending between said opposite ends, said sides having a plurality of circumferentially and axially spaced wall portions;

(b) an electric light supported on said arm;

(c) wiring connected to said electric light and through said arm;

(d) means defining an aperture in the tubular arm at a first of said wall portions of said sides of said arm, said aperture being adapted to provide entry of an electric power supply line into said arm for making an electrical connection of an end of the electric power supply line with an end of said wiring;

(e) means defining an access opening in said arm at a second of said wall portions of said sides of said arm being spaced from said first wall portion thereof, said access opening being located adjacent to the location of the electrical connection between the end of the electric power supply line and said end of said wiring for permitting making of, and providing access to, the electrical connection;

(f) a cover removably attached to said arm at said second wall portion thereof so as to overlie and close said access opening in said arm such that said cover is capable of being removed and reattached without affecting the electrical connection between the electric power supply line and said end of said wiring, said cover also being absent any aperture which would align with said access opening in said second wall portion of said arm when said cover is attached to said arm and permit entry of either said electric power supply line or said wiring through said cover and through said access opening in said second wall portion of said arm.

8. The assembly as recited in claim 7, wherein said first and second wall portions of said arm are axially spaced from one another along said arm.

9. The assembly as recited in claim 7, wherein said first and second wall portions of said arm are circumferentially spaced from one another about said arm.

10. The assembly as recited in claim 7, wherein said first and second wall portions of said arm are circumferentially and axially spaced from one another respectively along and about said arm.

11. The assembly as recited in claim 7, wherein said plurality of sides of said tubular arm includes opposing top and bottom sides and opposing lateral sides, said first wall portion containing said entry aperture being located on said top side of said arm, said second arm portion containing said access opening being located on one of said lateral and bottom sides of said arm.

12. The assembly as recited in claim 7, further comprising:

a bracket spaced from said electric light and attached to said tubular arm for supporting said arm from an external structure, said bracket being attached to one of said opposite ends of said arm and said electric light being attached to the other of said opposite ends of said arm.

* * * * *